US010882095B2

(12) United States Patent
Maestri et al.

(10) Patent No.: US 10,882,095 B2
(45) Date of Patent: Jan. 5, 2021

(54) HEMMING HEAD

(71) Applicant: Comau S.p.A., Grugliasco (IT)

(72) Inventors: Mauro Maestri, Grugliasco (IT); Valeria Serpi, Grugliasco (IT); Giovanni Di Stefano, Grugliasco (IT); Sylvain Petit, Trappes (FR); Olivier Carqueville, Trappes (FR)

(73) Assignee: Comau S.p.A., Grugliasco (IT)

( * ) Notice: Subject to any disclaimer, the term of this patent is extended or adjusted under 35 U.S.C. 154(b) by 0 days.

(21) Appl. No.: 15/867,826

(22) PCT Filed: Oct. 6, 2017

(86) PCT No.: PCT/IB2017/056181
§ 371 (c)(1),
(2) Date: Jan. 11, 2018

(87) PCT Pub. No.: WO2018/069801
PCT Pub. Date: Apr. 19, 2018

(65) Prior Publication Data

US 2019/0255589 A1 Aug. 22, 2019

(30) Foreign Application Priority Data

Oct. 10, 2016 (EP) ..... 16193146

(51) Int. Cl.
*B21D 39/02* (2006.01)

(52) U.S. Cl.
CPC ..... *B21D 39/023* (2013.01); *B21D 39/021* (2013.01)

(58) Field of Classification Search
CPC . B21D 7/02; B21D 7/04; B21D 39/00; B21D 39/02; B21D 39/021; B21D 39/023;
(Continued)

(56) References Cited

U.S. PATENT DOCUMENTS 2,091,474 A 8/1937 Elliot
4,021,909 A 5/1977 Bollmer
(Continued)

FOREIGN PATENT DOCUMENTS

CN 101166588 A 4/2008
CN 101203339 A 6/2008
(Continued)

OTHER PUBLICATIONS

Notification of Transmittal, International Search Report and the Written Opinion of the International Searching Authority dated Oct. 24, 2012 from corresponding International Application PCT/IB2012/052562 filed May 22, 2012.

*Primary Examiner* — Pradeep C Battula
(74) *Attorney, Agent, or Firm* — Young Basile Hanlon & MacFarlane, P.C.

(57) ABSTRACT

Described herein is a new method and device for operating a hemming head of the type comprising a hemming roller (101) and a second, opposed, roller (102), which are rotatable about respective axes contained in one and the same plane. The method includes variation of the position of the second roller that is opposed to the hemming roller as a function of a signal indicating the force exerted by said second roller on the metal sheet and/or as a function of a signal indicating the position of the head along the machining path.

13 Claims, 8 Drawing Sheets

(58) Field of Classification Search
CPC . B21D 5/06; B21D 5/006; B21D 5/15; B21D 5/16
See application file for complete search history.

(56) References Cited

U.S. PATENT DOCUMENTS

| | | | | |
|---|---|---|---|---|
| 4,656,858 | A | 4/1987 | Addison | |
| 4,955,654 | A | 9/1990 | Tsuchihashi et al. | |
| 6,644,083 | B2 * | 11/2003 | Pakker | B21D 19/046 72/379.2 |
| 7,121,129 | B2 | 10/2006 | Binggeli | |
| 7,152,447 | B2 | 12/2006 | Toeniskoetter | |
| 7,254,973 | B2 | 8/2007 | Campian | |
| 7,290,423 | B2 | 11/2007 | Carsley et al. | |
| 7,779,524 | B2 | 8/2010 | Campian | |
| 7,855,350 | B2 | 12/2010 | Schurmann et al. | |
| 7,950,260 | B2 | 5/2011 | Kinouchi et al. | |
| 8,024,950 | B2 | 9/2011 | Harrow et al. | |
| 9,571,502 | B2 | 2/2017 | Basso et al. | |
| 2004/0045940 | A1 | 3/2004 | Angel | |
| 2006/0081331 | A1 | 4/2006 | Campian | |
| 2006/0122730 | A1 | 6/2006 | Niemela et al. | |
| 2006/0158152 | A1 | 7/2006 | Taniguchi et al. | |
| 2007/0209420 | A1 | 9/2007 | Campian | |
| 2007/0228018 | A1 | 10/2007 | Murai et al. | |
| 2008/0147089 | A1 | 6/2008 | Loh et al. | |
| 2008/0223170 | A1 | 9/2008 | Tealdi et al. | |
| 2008/0250835 | A1 * | 10/2008 | Hasegawa | B21D 39/023 72/220 |
| 2008/0302159 | A1 | 12/2008 | Toeniskoetter et al. | |
| 2009/0038361 | A1 | 2/2009 | Toeniskoetter | |
| 2009/0235712 | A1 | 9/2009 | Padmanabhan et al. | |
| 2009/0235713 | A1 | 9/2009 | Toeniskoetter | |
| 2010/0241260 | A1 | 9/2010 | Kilibarda et al. | |
| 2010/0242561 | A1 | 9/2010 | Reith et al. | |
| 2011/0107807 | A1 | 5/2011 | Sato et al. | |
| 2011/0153034 | A1 | 6/2011 | Philliben et al. | |
| 2011/0172788 | A1 | 7/2011 | Kilibarda et al. | |
| 2012/0067851 | A1 | 3/2012 | Lee | |
| 2012/0180559 | A1 | 7/2012 | Koumoto et al. | |
| 2012/0181256 | A1 | 7/2012 | Rotheut et al. | |
| 2012/0197573 | A1 | 8/2012 | Pecher | |
| 2012/0210802 | A1 | 8/2012 | Sarh et al. | |
| 2012/0247208 | A1 | 10/2012 | Takahashi | |
| 2012/0297854 | A1 | 11/2012 | Cyrek et al. | |
| 2013/0056451 | A1 | 3/2013 | Hasegawa et al. | |
| 2013/0075378 | A1 | 3/2013 | Sakai | |
| 2013/0211418 | A1 | 8/2013 | Lim et al. | |
| 2014/0048523 | A1 | 2/2014 | Moision et al. | |
| 2015/0108099 | A1 | 4/2015 | Ferrero et al. | |
| 2018/0236594 | A1 | 8/2018 | Gattabria et al. | |

FOREIGN PATENT DOCUMENTS

| | | | |
|---|---|---|---|
| CN | 102059295 | A | 5/2011 |
| DE | 10111374 | B4 | 2/2005 |
| DE | 202004012580 | U1 | 9/2005 |
| DE | 102004042213 | A1 | 3/2006 |
| DE | 102008047800 | A1 | 11/2009 |
| DE | 202011000315 | U1 | 5/2012 |
| EP | 2160258 | A1 | 3/2010 |
| FR | 2895690 | A1 | 7/2007 |
| KR | 20140117141 | A | 10/2014 |
| WO | 2008145396 | A1 | 12/2008 |
| WO | 2012160512 | A1 | 11/2012 |

* cited by examiner

HEMMING HEAD

TECHNICAL FIELD

The present invention relates to a hemming head for metal sheets.

BACKGROUND

Hemming heads for metal sheets are generally known, of the type comprising:

- a supporting structure, carrying a first roller and a second roller, which, during operation, set themselves in opposed positions with respect to the edge of the metal sheet to be bent and which are freely rotatable about a first axis and a second axis, respectively, said first and second axes being both contained in one and the same plane; and
- a device configured for regulating the inclination of said first axis, with respect to said second axis, in said plane.

A hemming head of the type referred to above is, for example, described in the German patent No. DE10111374BA4.

This type of hemming head presents first of all the advantage of being able to operate without the need of any base designed to keep the edges of the metal sheets fixed in position thanks to the presence of the second roller referred to, which, during operation, sets itself in a position opposed to the hemming roller, with respect to the edges of the metal sheet, and travels together therewith so as to define locally a contrast element for the aforesaid edges.

Furthermore, thanks to the possibility of regulating the inclination of the hemming roller, the hemming head in question provides the further advantage of simplifying the hemming operations since the head may be kept substantially with one and the same orientation in space, in the multiple passes that the entire hemming operation envisages along the perimetral edges of the metal sheet, by simply varying the inclination of the hemming roller.

SUMMARY

The object of the present invention is to improve the solution discussed above.

In particular, the object of the present invention is a new method for operating a hemming head of the type referred to above that will be able to guarantee a better machining quality.

Furthermore, the present invention proposes, for the type of hemming head in question, a new structural configuration that is advantageous both from the constructional standpoint and from the functional standpoint.

BRIEF DESCRIPTION OF THE DRAWINGS

Further characteristics and advantages of the invention will emerge clearly from the ensuing description, with reference to the annexed drawings, which are provided purely by way of non-limiting example and in which.

DETAILED DESCRIPTION

In the ensuing description various specific details are illustrated aimed at providing an in-depth understanding of the embodiments. The embodiments may be obtained without one or more of the specific details, or with other methods, components, or materials, etc. In other cases, known structures, materials, or operations are not illustrated or described in detail so that various aspects of the embodiment will not be obscured.

The references used herein are provided merely for convenience and hence do not define the scope of protection or the scope of the embodiments.

As mentioned above, the hemming head described herein is of the type comprising:

- a supporting structure carrying a first roller and a second roller, which, during operation, set themselves in opposed positions with respect to the edge of the metal sheet to be bent and which are freely rotatable about a first axis and a second axis, respectively, said first and second axes being both contained in one and the same plane; and
- a device configured for regulating the inclination of said first axis with respect to said second axis in said plane.

Figure 2:
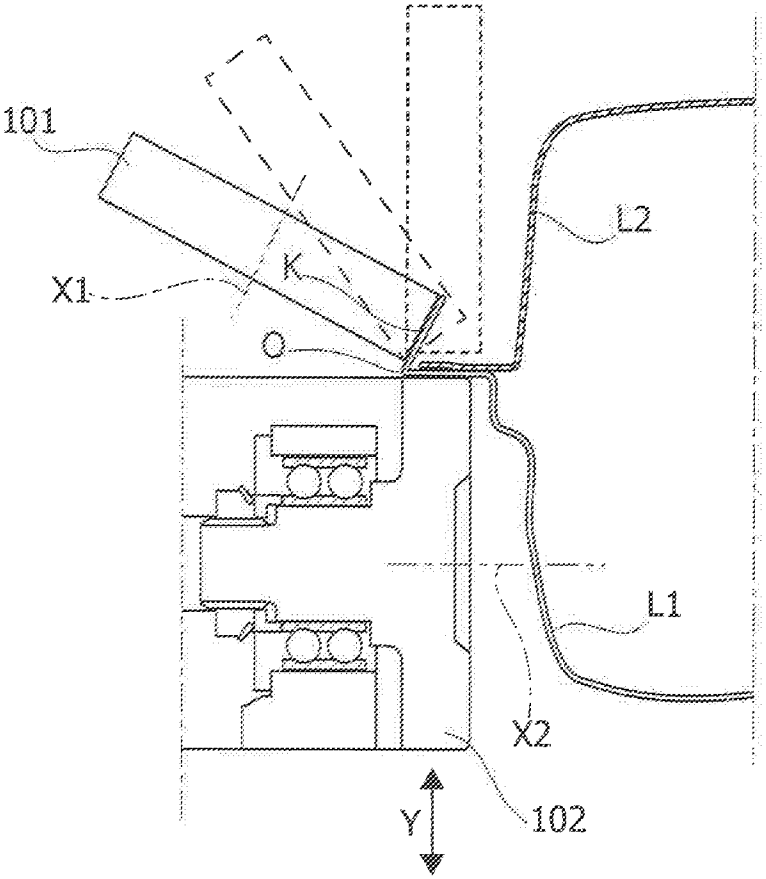
FIG. 2 is a schematic illustration, provided by way of example, of different operative positions of the rollers of the hemming head described herein.
Figure 3:
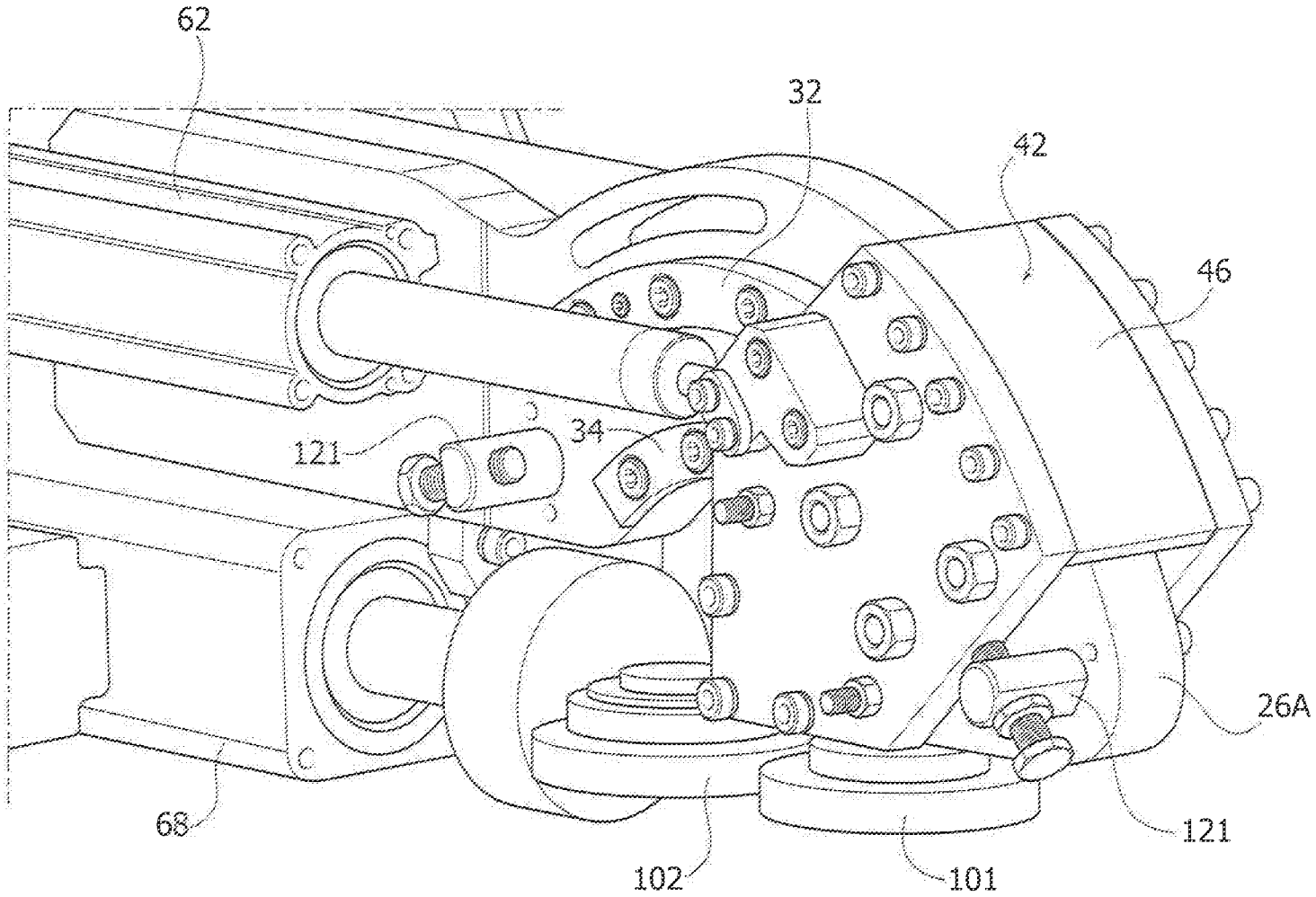
FIG. 3 is a perspective view of the front side of the hemming head of FIG. 1.
Figure 4:
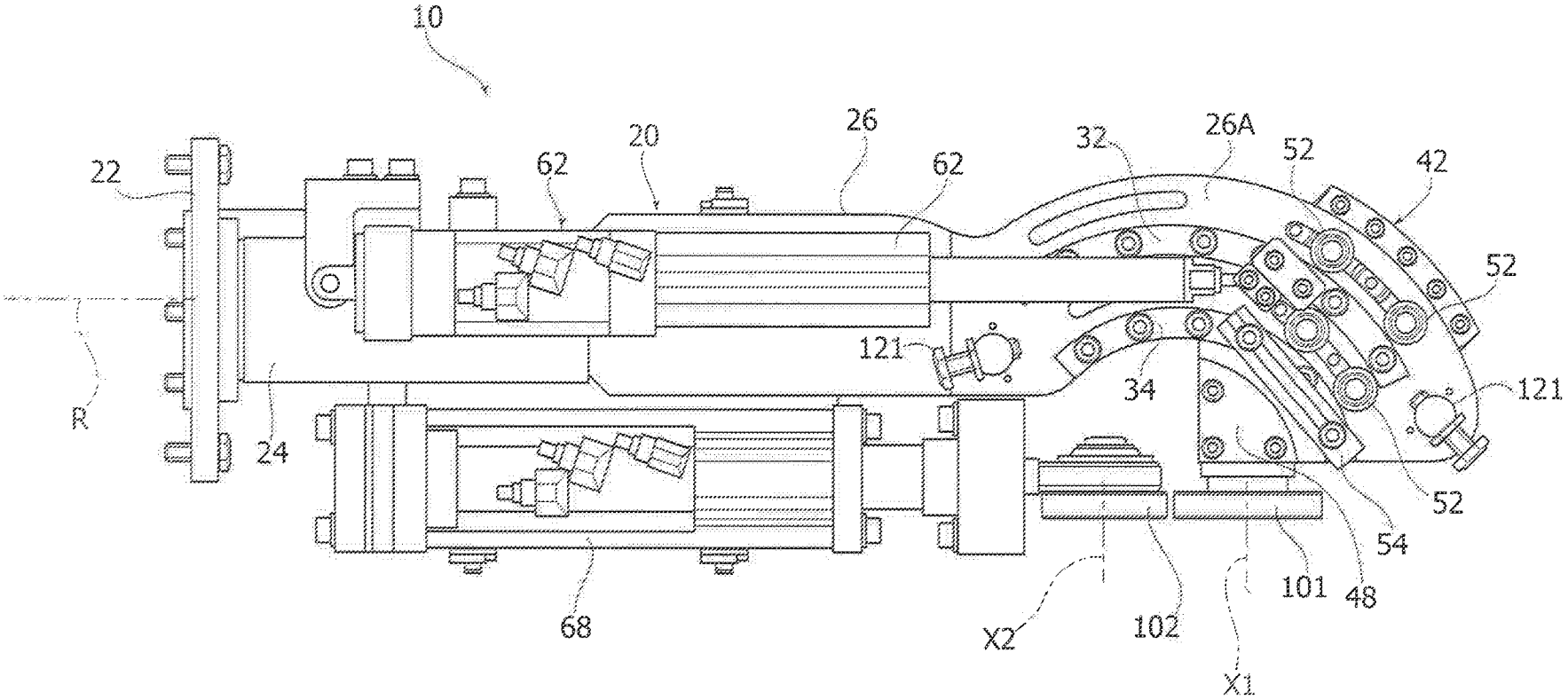
FIG. 4 corresponds to the view of FIG. 1, from which some elements of the device for regulating inclination of the hemming roller have been removed in order to illustrate the internal elements of said device.
Figure 5:
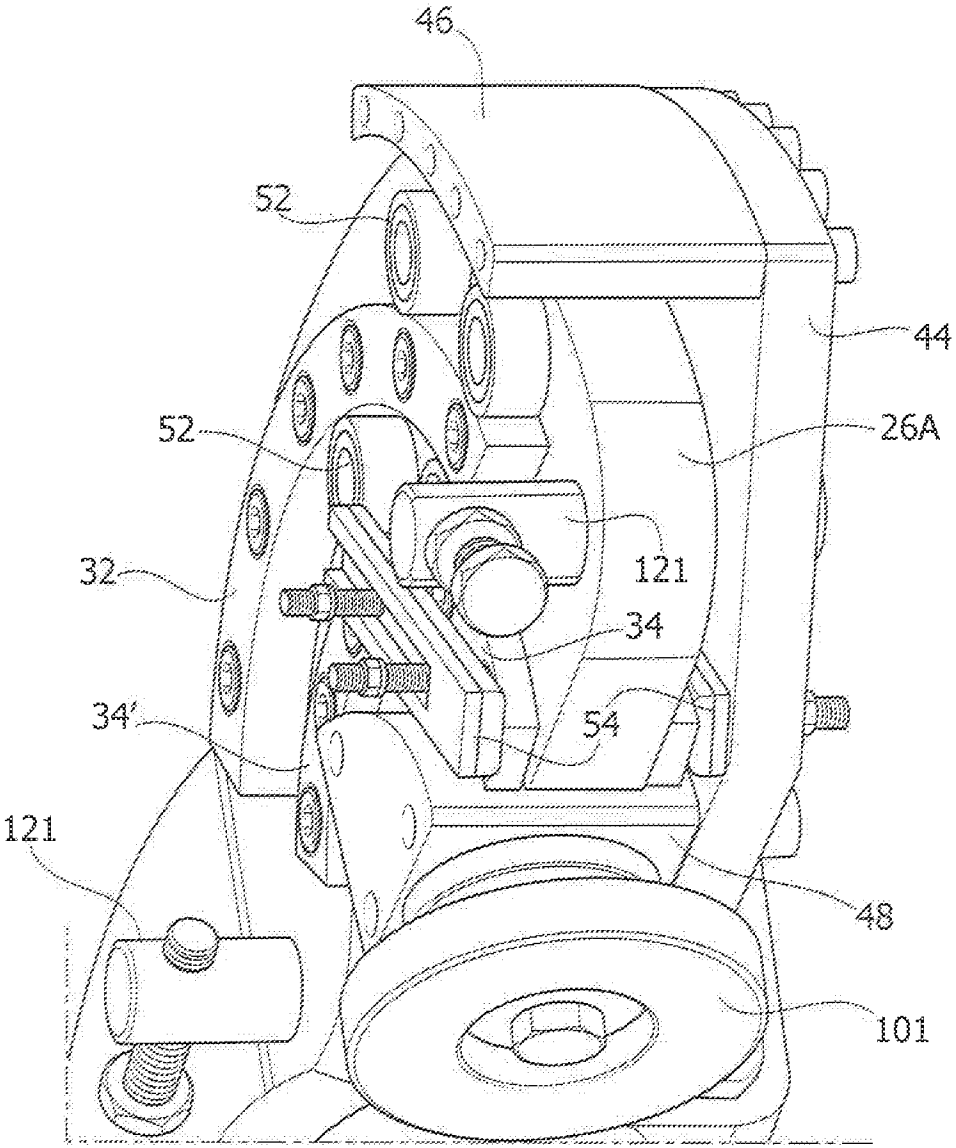
FIG. 5 illustrates a perspective view of the front portion of the hemming head of FIG. 1, from which some elements of the device for regulating the inclination of the hemming roller have been removed in order to illustrate the internal elements of said device.
Figure 6:
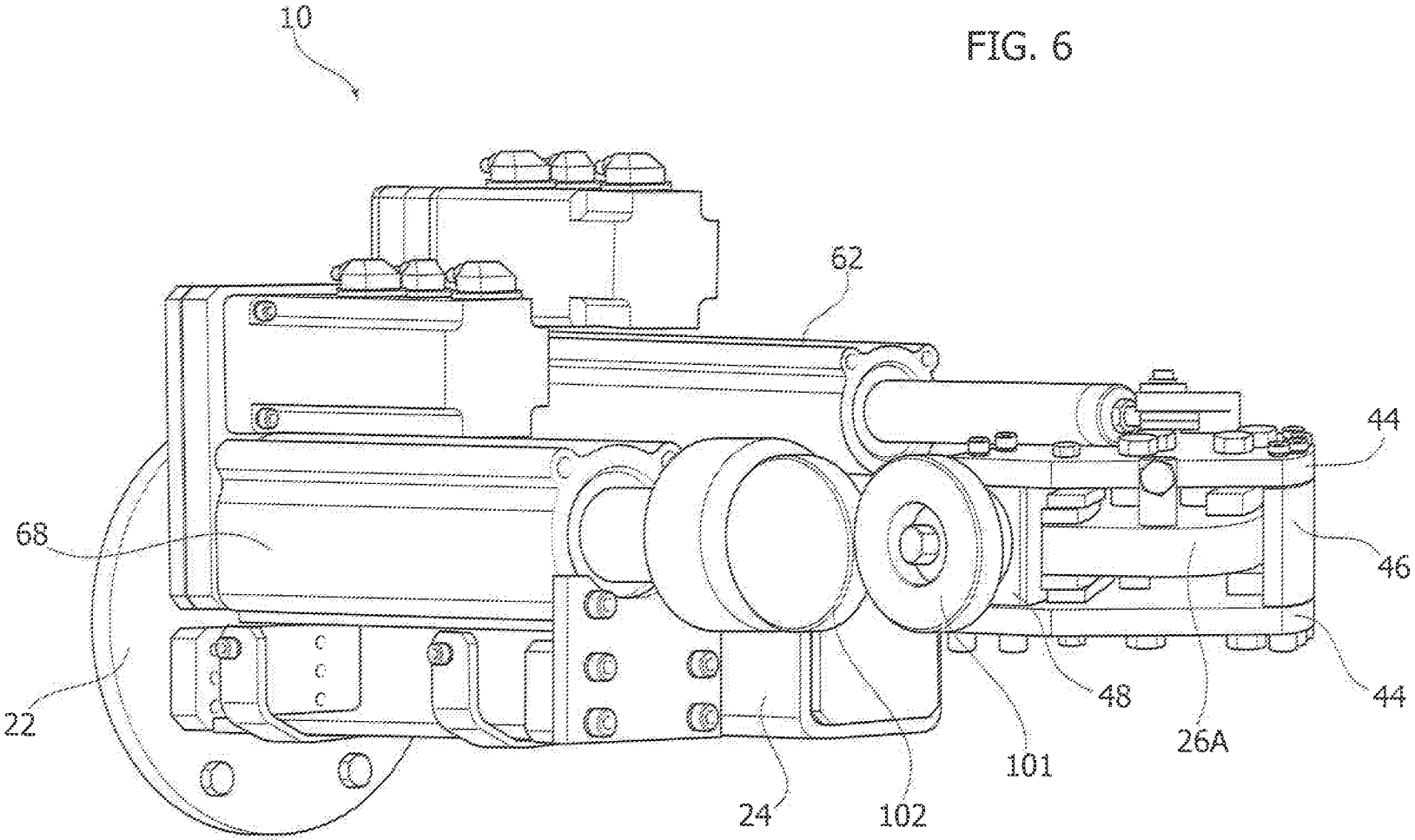
FIG. 6 is an axonometric view of the hemming head of FIG. 1 taken from beneath.

FIG. 2 is a schematic illustration of mode of operation of the two rollers of the hemming head described herein, during hemming of two metal sheets L1, L2.

The hemming roller, designated by the reference 101, assumes a position such that its outer cylindrical surface sets itself in contact with the edge K—already partially bent—of the outer metal sheet L1.

The contrast roller 102 sets itself, instead, in a position opposed with respect to the hemming roller 101 in such a way as to support with its outer cylindrical surface the respective portions of the two metal sheets L1, L2 immediately adjacent to the edge K. The roller 102 has, in particular, the function of keeping these portions fixed in position so as to prevent them from undergoing deformation and moreover guarantee that the action of the hemming roller results in the edge being bent with the desired geometry.

In a hemming head of the type described herein, thanks to the aforementioned device for regulating inclination (which will be described in detail hereinafter), the hemming roller 101 can be oriented with different inclinations with respect to the roller 102 in order to vary the angle of bending that the two rollers 101 and 102 come to form between the edge K and the portions T1 and T2 of the two metal sheets.

In this connection, the hemming operation envisages guiding the hemming head along the perimetral portions of the two metal sheets to be hemmed, for a number of passes, and reducing, between one pass and the next, the inclination of the hemming roller 101 with respect to the roller 102 so as to bring, in a gradual way, in the course of the above passes, the edge K from a condition substantially orthogonal to the portions T1 and T2 to a condition in which it is bent against the aforesaid portions so that it is oriented parallel thereto.

The procedure so far described is in itself already known in the art.

Now, in the light of the foregoing, it will be noted that the geometry of the portions T1 and T2 and of the edge K basically depends upon the mutual positions assumed by the two rollers 101 and 102 in the course of the various passes envisaged during the hemming operation.

As in the prior art, these positions can be determined beforehand and then kept fixed during the entire machining process. In particular, it is possible, during a step of setting-up of the entire hemming system to identify, for each pass, the so-called optimal orientation for the hemming roller of the head, and then assume said datum as operating parameter. The opposed roller is in turn set in a pre-set position with respect to the hemming roller and kept permanently in this position. Clearly, also known in the art is the possibility of making adjustments during maintenance of the system in order to recover any possible play created on account of wear of the materials.

The present applicant has, however, found that it is possible to obtain better machining results as compared to the known art by regulating the vertical position (see FIG. 2) of the roller 102 dynamically with respect to the roller 101, during movement of the head along the edges of the metal sheet subjected to the hemming operation.

The present applicant has in fact noted that morphological discontinuities that may be encountered over one and the same path along the aforesaid edges (for example, variations of thickness, variations of the position of the bending line, local deformations, etc.), as likewise sudden variations of direction defined by the path itself, can cause locally, in the areas concerned, a bending of the edge of the metal sheet that is not optimal or is even ineffective.

The present applicant has thus found that it is instead possible to solve this problem by envisaging variation of the vertical position of the roller 102 with respect to the roller 101—in the direction Y in the example of FIG. 2—as a function of a signal indicating the force exerted by the roller 102 on the metal sheet and/or as a function of a signal indicating the position of the head along the path followed by the latter during the hemming operation.

The main purpose of this type of regulation is to ensure that the roller 102 always keeps the metal sheets in a position appropriately referenced with respect to the roller 101, as a function of any lack of homogeneity or structural peculiarities that characterize the pieces being machined so that the roller 101 will be set always in the condition of carrying out a correct operation of bending of the metal sheets.

The result obtained is a substantially uniform quality of bending of the metal sheet throughout perimeter concerned.

In various preferred embodiments, the method described herein moreover envisages dynamic variation, during the individual passes of the head along the hemming path, also of the inclination of the roller 101 with respect to the roller 102. In preferred embodiments, this is done only as a function of a signal indicating the position of the head along the hemming path; it is in any case possible to envisage a control based also upon a signal indicating the force exerted by the roller 101 on the metal sheet, as already discussed above with reference to the roller 102.

Figure 7A:
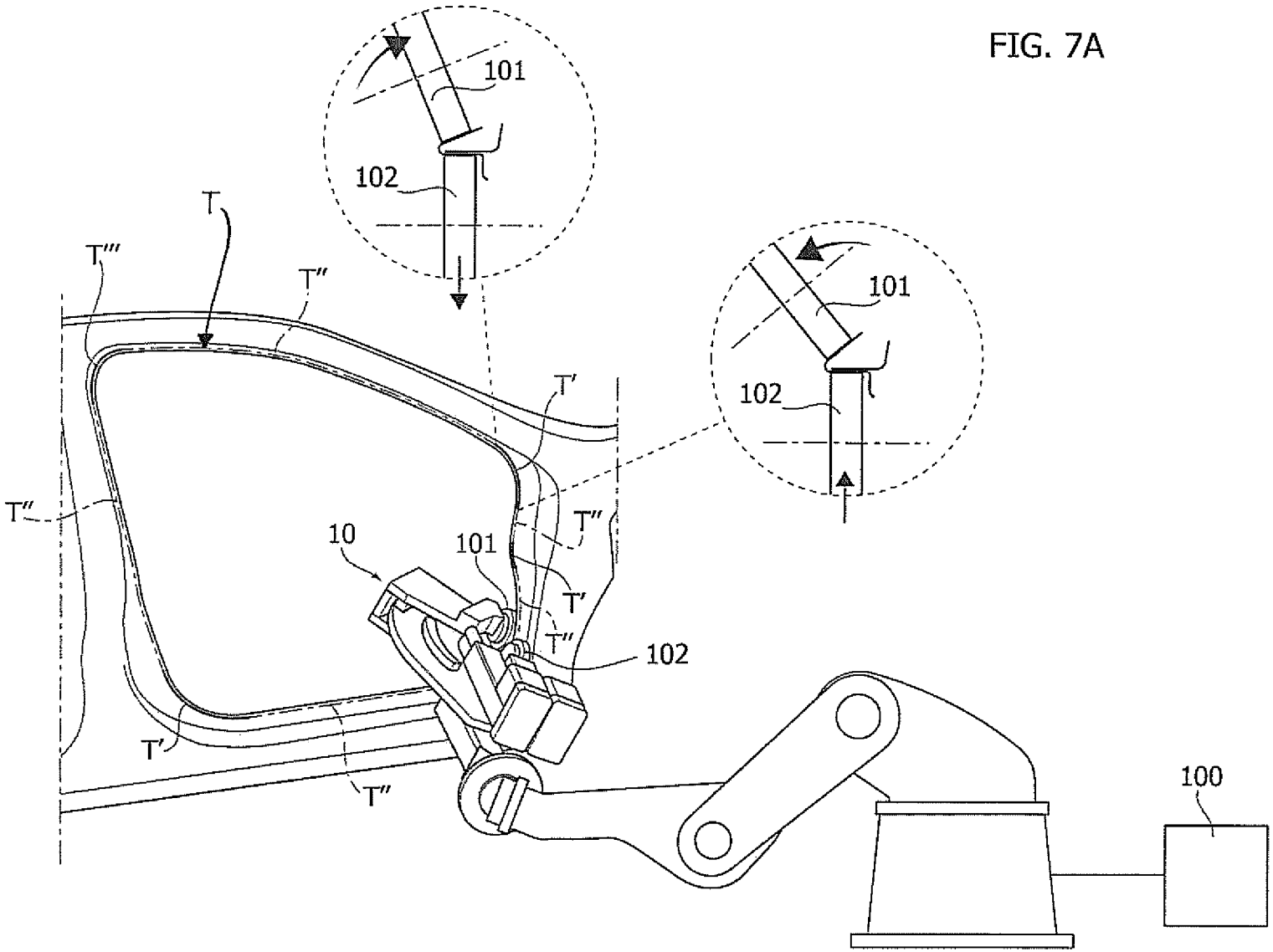
FIGS. 7A-C are schematic illustrations of various examples of operation of the hemming head of FIG. 1.
Figure 7B:
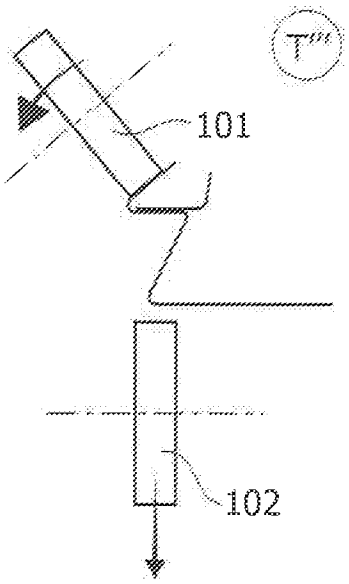
Figure 7C:
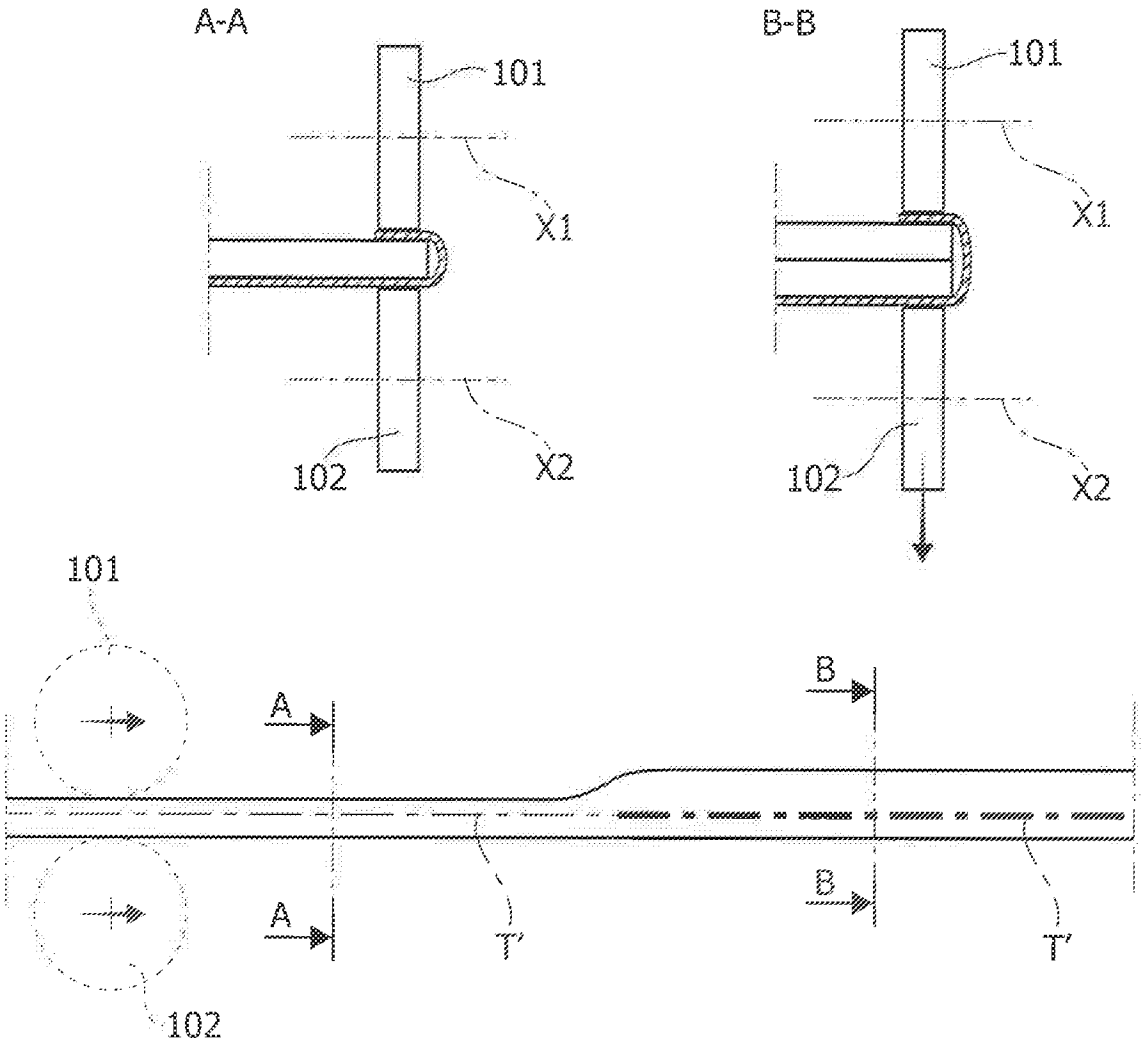

FIGS. 7A-C are schematic illustrations of some examples of operation of a hemming head according to the method described herein.

Starting from FIG. 7A, this is a schematic illustration of the side of a motor-vehicle body on which the hemming head 10 described herein carries out a hemming operation, around the door opening, to join together the two metal sheets constituting the side. The head 10 is carried by a manipulator robot, and a control unit 100 governs the operations of the robot and of the head.

In this figure, designated by the reference T is the path followed by the head 10 during this operation.

Identified on this path are stretches T' and T" that differ from one another in that the former are curved stretches with a considerable curvature, whereas the latter are substantially rectilinear stretches or in any case ones with just a slight curvature.

As regards this example of application, the method described herein hence envisages associating to the various stretches T' and T" differentiated positions of the roller 101 and, possibly, also of the roller 102.

It should now be noted that experimental tests have highlighted that in general, where the curvature of the path is more accentuated, to perform an action of effective bending on the metal sheet, it is necessary to bring the roller 101 into a more inclined position with respect to the roller 102.

On the basis of the foregoing, the method described herein will hence envisage associating to the stretches T' positions of the axis X1 with a greater angle of inclination than in the case of the stretches T". According to the particular geometry of the metal sheet, there may then become necessary for the stretches T' also an adjustment of the position of the roller 102, for example moving it towards, or away from, the roller 101, with respect to the position that is assumes along the other stretches T". During operation, the hemming head 10 will hence set the rollers 101 and 102 in different positions on the bases of the stretch on which it is located.

Furthermore, within one and the same stretch, the hemming head is pre-arranged for further regulating the position of the roller 102 as a function of the force exerted by this on the metal sheets, in particular so that the force will be controlled and maintained at a given pre-set value irrespective of the specific conditions of the metal sheets that the head may find during its movement and that could, instead, cause the amount of force exerted by the roller 102 to depart from the above pre-set value. For instance, in the case where the head encounters a localized increase of thickness of one or both of the metal sheets, a circumstance that may be such as to increase the value of force exerted by the roller 102, the control described herein envisages moving the roller 102 away from the roller 101 by a distance such as to compensate for the effects deriving from the local increase in thickness of the metal sheets.

It should be noted that the aforesaid parameters, namely, the different positions of the rollers 101 and 102 on the various stretches T', T" and the pre-set value of force for each of these stretches, may be derived empirically in a step of setting-up of the machining cycle, by verifying, via various experimental tests conducted in a scenario identical to the one in which the real machining cycle will be carried out, what are the values of these parameters that enable optimal bending of the edge of the metal sheet.

The values obtained can then be stored in the control unit 100.

The unit 100 will govern the robot and the head 10 using these parameters and on the basis of the signals mentioned above indicating the force exerted by the roller 102 and the position of the hemming head. In this connection, it should be noted that these signals are clearly obtained via sensor means associated to the robot and to the head 10. In particular, the position of the hemming head may clearly correspond to the end-effector position controlled and governed by the unit 100 through the aid of the various encoders associated to the joints of the robot. The aforementioned signal indicating the position of the hemming head will comprise data identifying co-ordinates within a reference system, for example, a cartesian reference system, a cylindrical reference system, etc.

The unit 100 may be of any type that is conventionally used for operating and controlling automated machining systems. It will comprise both the control modules for the various actuators, which contain, for example, the inverters for governing the electric motors and the programming modules for setting and controlling the actions of the various operating members of the system. Obviously, these modules may also be physically separate according to the specificities and requirements of the various applications.

As illustrated in FIG. 7B, along the path T of the example of FIG. 7A it is also possible to encounter stretches T" in which the metal sheet has, on the inside or on the outside, undercut portions, which would render particularly problematical the use of the roller 102, as a result of the risk of interference between the roller and these portions.

In this case, the method described herein envisages association to the stretch T"' of a position of the roller 102 completely retracted and set at a distance from the roller 101, in which the roller 102 becomes practically inoperative. As soon as the head then moves onto the next stretch T", the roller 102 will automatically set itself once again in contact with the metal sheet.

FIG. 7C illustrates, instead, the operation of hemming of two metal sheets of a generic component of the bodywork or of the body of a motor vehicle, which is characterized in that the band of joining of the two metal sheets has along its direction of extension two areas of different thickness.

The method described herein envisages distinguishing on the path T that the hemming head will follow, two different stretches T' and T' that identify these areas.

The method will hence envisage associating to the stretches T' and T" differentiated positions of the roller 102, along the axis Y, appropriately regulated on the basis of the different thicknesses of the two areas in question.

Similarly to what has been described above, the method disclosed herein will moreover envisage further regulating the position of the roller 102 as a function of the force exerted by this on the metal sheet, to cause this force to be controlled and maintained at a given pre-set value.

In all the cases described above, the result obtained by the hemming operations conducted according to the method disclosed herein will be a joining that is homogeneous throughout its extension, with constant thicknesses—where obviously the metal sheets have a constant thickness—whatever the profile and the curvatures of the hemming path, and irrespective of any lack of morphological homogeneity and/or geometrical homogeneity, at localized points, on the metal sheet.

As regards what has been said above, it should again be noted that the stretches T', T", and T" referred to may in some cases also correspond to single points.

With reference now to the hemming head, this is characterized, as compared to the hemming heads of the known art, precisely in that the axis of rotation of the roller 102 is defined by a member that is pre-arranged for varying the position of this axis during movement of the head along the edges of the metal sheets undergoing the hemming operation.

In various preferred embodiments, the above member is represented by the mobile element of a linear actuator.

In any case, aside from the aspect regarding adjustment of the position of the roller 102, in general the hemming head described herein is characterized as a whole by a series of structural characteristics that render it particularly advantageous.

In this connection, with reference to FIGS. 1 to 6, the hemming head 10 comprises a supporting structure 20 on which the rollers 101 and 102 are mounted, in the modalities that will be described in detail hereinafter, and which is equipped with a connection portion 22 for fixing of the head to an automated-movement device such as a manipulator robot, as in the application illustrated in FIG. 7.

The connection portion 22 defines a reference axis R, which, during operation, will represent an operative axis of the hemming system, with reference to which the control unit of the system can control the position and orientation in space of the head 10.

The supporting structure 20 has a main body 24, which extends in cantilever fashion from the connection portion 22 along the axis R or in any case parallel thereto.

Preferably, the body 24 is in the form of a box-like body made of sheet metal, having various portions prepared for fixing of the other components of the head thereon, as will be seen in what follows.

In various preferred embodiments, as in the one illustrated, fixed on the end, or else on a side of said body, is a plate 26 that is oriented parallel to the axis R and projects at the front, with a portion 26A thereof, from the body 24; the latter has a main direction of extension that is characterized by a curvilinear development.

Mounted on the supporting structure 20 just described is the device mentioned previously designed to regulate the inclination of the hemming roller 101.

In particular, as is represented schematically in FIG. 2, this device is configured for varying the inclination of the roller 101, i.e., of its axis X1, substantially through a movement of rotation of this axis about a reference axis O, which is located on the outer surface of the roller and, in the example illustrated, passes through the vertex of the section of the roller that is located closest to the bending line defined on the metal sheet L1 (see FIG. 2); this specific modality of movement guarantees the best condition of contact between the cylindrical surface of the roller and the edge of the metal sheet, for any position assumed by the roller.

With reference to the constructional details of the above device, in various preferred embodiments, as in the one illustrated, it envisages a guide system that comprises two pairs of bars 32, 34 fixed on the two opposite sides of the projecting portion 26A. Furthermore, the device comprises a carriage 42, which carries the hemming roller 101.

The carriage 42 defines as a whole a box-like body open on two opposite ends that are traversed by the portion 26A. Specifically, the body is defined by two plates 44 that are oriented parallel to one another and to the portion 26A and are set with respect to the latter in opposed positions. The plates 44 are joined together by the transverse plates 46, 48, which are set, respectively, at the two opposite lateral edges of the portion 26A. The roller 101 is rotatably mounted about the axis X1 on the plate 48, which is located on the side of the reference axis O.

The bars 32 and 34 have a polygonal, preferably rectangular, cross section and extend longitudinally according to a curvilinear development, like the projecting portion 26A.

The bars 32 are set in an internal region of the respective side of the portion 26A and in practice constitute the two rails on which the carriage 42 travels. For this purpose, the opposite longitudinal edges of each bar 32 have curvilinear profiles that have a common centre of curvature positioned along the reference axis O referred to above. These opposite edges are engaged by an array of opposed wheels 52, which are mounted on the corresponding plate 44, facing the bar 32, of the carriage 42.

The bars 32 hence have the function of guiding the carriage 42 in a movement in an ideal plane defined by the portion 26A itself, along a curvilinear path, the centre of curvature of which is positioned on the reference axis O. The roller 101 is positioned on the carriage 42 in such a way that to the movement of translation of the carriage there approximately corresponds a rotation of its axis X1 about the reference axis O.

The bars 34 constitute, instead, guides for lateral containment of the carriage, i.e., to keep the latter in a fixed position in the direction transverse to the plane of movement. For its own part, the carriage 42 has, once again on the inner sides of the plates 44 on which also the wheels 52 are fixed, sliding blocks 54 designed to engage the outer faces 34' of the bars 34. Preferably, the sliding blocks 54 are mounted on the plates 44 according to a configuration that enables variation of their position with respect to the plates themselves, for example via screw fixing members and interposition of interchangeable shims in order to enable adjustment of the lateral position of the carriage, as well as recover any possible play.

Again, in various preferred embodiments, the guide system of the device described herein is pre-arranged for enabling adjustment of the radial distance (with reference to the curvilinear path defined by the bar 32) between the wheels 52 that engage the opposite edges of one and the same bar 32 in order to facilitate installation of the carriage 42 on the plate 26A and moreover, also in this case, to enable compensation of any possible play. In various preferred embodiments, for this purpose, the system envisages that the wheels 52 that engage one of the two opposite sides of the bar 32 will be mounted on the plate 44 via interposition of a connection member having an eccentric profile.

The device in question further comprises a linear actuator 62, which is mounted with its basic casing on the supporting structure 20, in particular on the body 24 or else on the plate 26, in such a way as to be able to oscillate in a plane parallel to the plane of movement of the carriage 42. The end of the mobile member of the actuator is in turn connected to the carriage 42, preferably at one of the two plates 44, also in this case in such a way that the member can oscillate with respect to the carriage.

Figure 1:
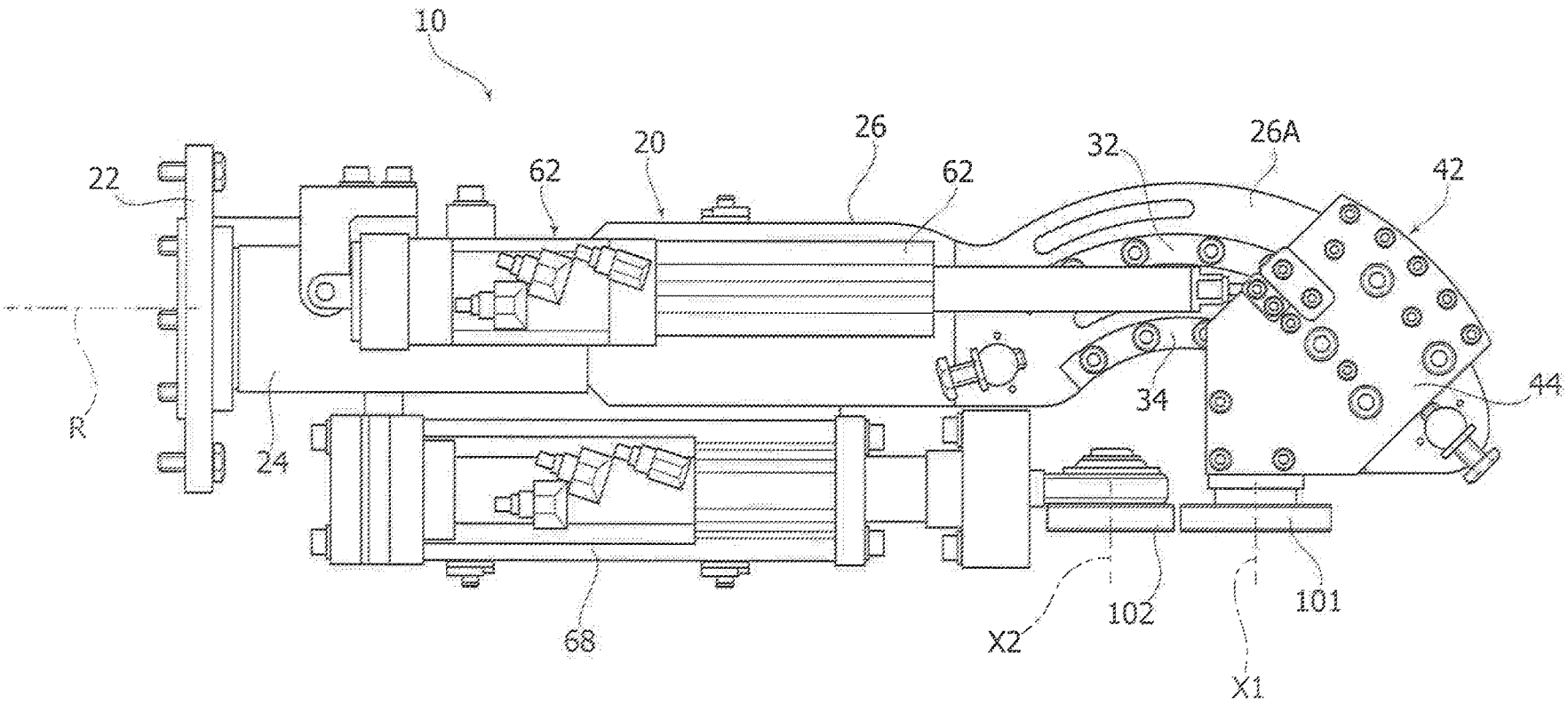
FIG. 1 illustrates a preferred embodiment of the hemming head described herein, according to a side view.

With reference now to FIGS. 1 and 2, it will be understood that actuation of the above actuator from the condition of minimum extension to the condition of maximum extension, brings about displacement of the carriage 42 from an end position adjacent to the body 24 of the supporting structure 20 (towards the left as viewed in FIG. 1) to an end position towards the tip of the projecting portion 26A (towards the right as viewed in FIG. 1).

With reference to the roller 101, this movement of the carriage will correspond to passage of the roller from a maximum inclination with respect to the roller 102 to a zero inclination. The carriage 42, and consequently the roller 101, may assume all the intermediate positions comprised between these end positions.

With reference to the inclination device, it should again be noted that mounted on one or both of the opposite sides of the portion 26A are corresponding end-of-travel members 121 for the two end positions referred to above of the carriage, which are arranged at the opposite ends of the bars 32 and 34. The members in question envisage threaded elements for precise adjustment of the end-of-travel position.

The linear actuator referred to is preferably constituted by a screw actuator governed by an electric motor. Alternatively, it is in any case possible to envisage actuators of some other type, for example pneumatic or hydraulic cylinders.

This actuator will be controlled for governing the roller 101 according to the modalities discussed above. In particular, during the hemming operation, it will govern the roller 101 in a series of pre-set inclined positions, each of which is associated to the various passes of the head along the hemming path, in order to perform gradual bending of the edge of the metal sheet. Furthermore, as has been seen above, during the individual passes, the roller 101 will instead be adjusted in a finer way as a function of the position of the head along the hemming path in order to adapt its position to the possible peculiarities of the join being made.

With reference now to the roller 102, as has been seen above, in the hemming head described herein it is carried by a mobile member, like the roller 101. With reference to FIG. 2, it should be noted that in the case of the roller 102 its direction of movement is orthogonal to the axis of rotation X2 and is contained in the same plane defined by the two axes X1 and X2.

In various preferred embodiments, as in the one illustrated, this member is constituted by the mobile element of a linear actuator 68, which is mounted on the supporting structure 20, in particular on the body 24 of this structure, with the aid of anchoring brackets, and is oriented so that its operative axis is parallel and/or aligned to the aforesaid direction of movement of the roller 102. In various embodiments, the mobile member of the actuator is associated to one or more linear guides (not illustrated), which engage it preferably at its portion that projects outwards, in order to prevent phenomena of slewing of this member and hence guarantee precise transverse positioning of the roller 102 with respect to the direction Y, whatever its position along the direction.

Also the aforesaid actuator will be governed according to the modalities already discussed above, i.e., in order to vary the position of the roller 102 as a function of a signal indicating the force exerted by this roller on the metal sheet and/or as a function of a signal indicating the position of the head along the pre-set path that this must follow during the hemming operation.

In this connection, it should be noted that the control unit described above may be configured for deriving the signal indicating the force exerted by the roller 102, and hence by the actuator, from the supply current of the actuator. Alternatively, the head 10 may be equipped with a force sensor associated to the mobile member of the actuator.

In the light of the foregoing, it may once again be noted—see in particular FIG. 1—that the hemming head 10 is characterized in that the two linear actuators 62 and 68 are both oriented with their own longitudinal direction substantially parallel (or possibly aligned) to the reference axis R. In particular, the linear actuator 62 is set so that, albeit oscillating, its operative axis is either parallel/aligned to the axis R, for one or more positions of the carriage along the bars 32, 34—in the example illustrated, in the end position of the carriage on the right—or anyway, in the other positions of the carriage, inclined with respect to the reference axis R according to an angle that it is never greater than 30°, and is preferably 15°.

Furthermore, both of the two actuators 62 and 68 are set with their own basic casing in the proximity of the connection portion 22, and they act both on the same side in a direction away from the aforesaid portion to bring the two respective rollers towards one another.

The characteristics highlighted above are such that the head has a prevalent development in the direction of the axis R and a lateral encumbrance that is, instead, very small. Advantageously, the centroid of the head is close to the connection portion 22 and, likewise, the electrical connectors of the two actuators are easy to reach.

The present applicant has been able to note that the configuration illustrated above offers from the operative standpoint greater possibility of manoeuvre of the head, above all in those applications in which the space available is particularly limited.

Of course, without prejudice to the principle of the invention, the details of construction and the embodiments may vary, even significantly, with respect to what has been illustrated herein purely by way of non-limiting example, without thereby departing from the scope of the invention, as defined by the annexed claims.

The invention claimed is:

1. A method for operating a hemming head (10) for hemming metal sheets including an outer metal sheet and an inner metal sheet, the outer metal sheet having an edge portion and an adjacent portion in communication with the edge portion, the hemming head comprising a supporting structure (20) carrying a first roller (101) and a second roller (102), which, during operation, are located in opposed positions with respect to the edge portion of the outer metal sheet to be bent and which are freely rotatable about a first axis (X1) and a second axis (X2), respectively, which are both contained in one plane, said method comprising the steps of:

guiding said first roller in contact with said edge portion of the outer metal sheet for at least one pass and a next pass along a pre-set hemming path (T);

guiding said second roller in contact with the adjacent portion of the outer metal sheet along the pre-set hemming path; and varying, between the at least one pass and the next pass, an inclination of said first roller (101) with respect to said second roller (102) in such a way that the inclination of said first roller will be different in the at least one pass than the next pass, in particular will be smaller in the next pass;

said method further comprising: during one or more of said at least one pass and the next pass, varying the position of said second roller (102) with respect to said first roller (101), in a direction transverse to said second axis and to said pre-set hemming path, as a function of at least one of a signal indicating a force exerted by said second roller on said outer metal sheet or a signal indicating a position of said head along said pre-set hemming path.

2. The method according to claim 1 further comprising:

dividing of said pre-set hemming path (T) into different stretches or points (T', T");

associating said stretches or points to a predetermined set of positions of said second roller (102) with respect to said first roller (101); and varying said position of said second roller to the respective predetermined set of positions as a function of a signal indicating the position of said head along said hemming path.

3. The method according to claim 1 wherein the variation of said position of said second roller (102) as a function of a signal indicating the force exerted by said second roller further comprises varying the position of the second roller as a function of a difference between the force exerted by said second roller (102) on said outer metal sheet and a predetermined reference value.

4. The method according to claim 3 further comprising:

dividing of said pre-set hemming path (T) into different stretches or points (T', T"); and associating respective predetermined reference values to said stretches or points.

5. The method according to claim 1 wherein during one or more of said at least one pass or said next pass, varying the inclination of said first roller (101) with respect to said second roller (102) as a function of a signal indicating the position of said head along said pre-set hemming path (T).

6. The method according to claim 5, further comprising:

dividing of said pre-set hemming path (T) into different stretches or points (T', T");

associating to said stretches or points a predetermined set of respective inclinations of said first roller (101) with respect to said second roller (102), varying the inclination of said first roller as a function of a signal indicating the position of said head along said pre-set hemming path.

7. A hemming head (10) for use in hemming metal sheets including an outer metal sheet and an inner metal sheet, the outer metal sheet having an edge portion and an adjacent portion in communication with the edge portion, the hemming head comprising:

a supporting structure (20) comprising:

a connection portion (22) operable to connect said hemming head to an automated-movement device, said connection portion defining a reference axis (R); and an actuator (62) having an operative axis parallel or aligned to said reference axis (R), said supporting structure carrying a first roller (101) and a second roller (102) which are freely rotatable about a first axis (X1) and a second axis (X2), respectively, said first and second axes being both contained in one plane, the supporting structure operable to locate the first roller and the second roller in opposed position with respect to the edge portion of the outer metal sheet to be bent;

an inclination regulation device operable to regulate an inclination of said first axis (X1) in said plane; and a linear actuator (68) having a mobile member operable to vary and define a position of said second axis (X2) in a direction transverse to said second axis and contained in said plane.

8. The hemming head according to claim 7, wherein said inclination regulation device further comprises:

a guide (32) defining a path having at least one curvilinear stretch;

a carriage (42) mobile on said guide along said path, said first roller (101) is mounted rotatable to the carriage about said first axis (X1); and the linear actuator (62) having a first end rotatably connected to said supporting structure (20), and a second end rotatably connected to said carriage (42) opposite the first end, wherein said path is shaped in such a way that said carriage (42) is mobile along said guide (32), via actuation of said linear actuator (62), between a first end position in which said first axis (X1) of said first roller (101) is located according to a maximum inclination with respect to said second axis (X2) of said second roller (102), and a second end position in which said first axis (X1) is located according to a minimum inclination with respect to said second axis (X2).

9. The hemming head according to claim 8, wherein said linear actuator (62) of said inclination regulation device is positioned so that the operative axis is parallel or aligned to said reference axis (R) of said connection portion (22) at least when said carriage is in one of said first and second end positions or in a position intermediate between them, whereas, when said carriage is in the other positions along said guide, said operative axis is oriented with respect to said reference axis according to an angle of inclination that is in a range of 0° to 30°.

10. The hemming head according to claim 9 wherein the angle of inclination is in a range of 0° to 15°.

11. The hemming head according to claim 8 wherein said linear actuator (68) that defines the position of said second axis (X2) and said linear actuator (62) of said inclination regulation device are positioned alongside one another and are oriented in such a way that during operation they both act in a direction away from said connection portion (22), to bring the respective first and second rollers (101, 102) towards one another.

12. The hemming head according to claim 8 wherein the minimum inclination of the first axis (X1) with respect to said second axis (X2) positions the first axis parallel to the second axis.

13. The hemming head according to claim 7 wherein the automated-movement device comprises a manipulator robot.

* * * * *